US007074065B1

(12) United States Patent
Martinez et al.

(10) Patent No.: US 7,074,065 B1
(45) Date of Patent: Jul. 11, 2006

(54) DOCKING UNIT WITH SPRING-LOADED CONNECTOR

(75) Inventors: Randy Grey Martinez, Burlington, NC (US); Jody Snow, Garner, NC (US)

(73) Assignee: Integrian, Inc., Morrisville, NC (US)

( * ) Notice: Subject to any disclaimer, the term of this patent is extended or adjusted under 35 U.S.C. 154(b) by 0 days.

(21) Appl. No.: 11/349,134

(22) Filed: Feb. 8, 2006

(51) Int. Cl.
*H01R 13/64* (2006.01)

(52) U.S. Cl. ..... 439/247; 439/948; 439/362

(58) Field of Classification Search ..... 439/247, 439/248, 362, 948
See application file for complete search history.

(56) References Cited

U.S. PATENT DOCUMENTS 5,088,935 A * 2/1992 Dise et al. ..... 439/573
6,527,572 B1 * 3/2003 Jou ..... 439/248
6,592,387 B1 * 7/2003 Komenda et al. ..... 439/247

* cited by examiner

*Primary Examiner*—Tho D. Ta
(74) *Attorney, Agent, or Firm*—John L. Sotomayor

(57) ABSTRACT

A spring-loaded connector plate and assembly installed within an equipment unit for insuring alignment of the connector and a receptacle connector as the equipment unit is inserted into a docking unit. The spring-loaded connector assembly also ensures mechanical and electrical connectivity with no damage to connector pins through repeated insert and remove operations between the equipment unit and equipment docking unit.

4 Claims, 4 Drawing Sheets

Assembly view with stop posts, springs, and spring posts

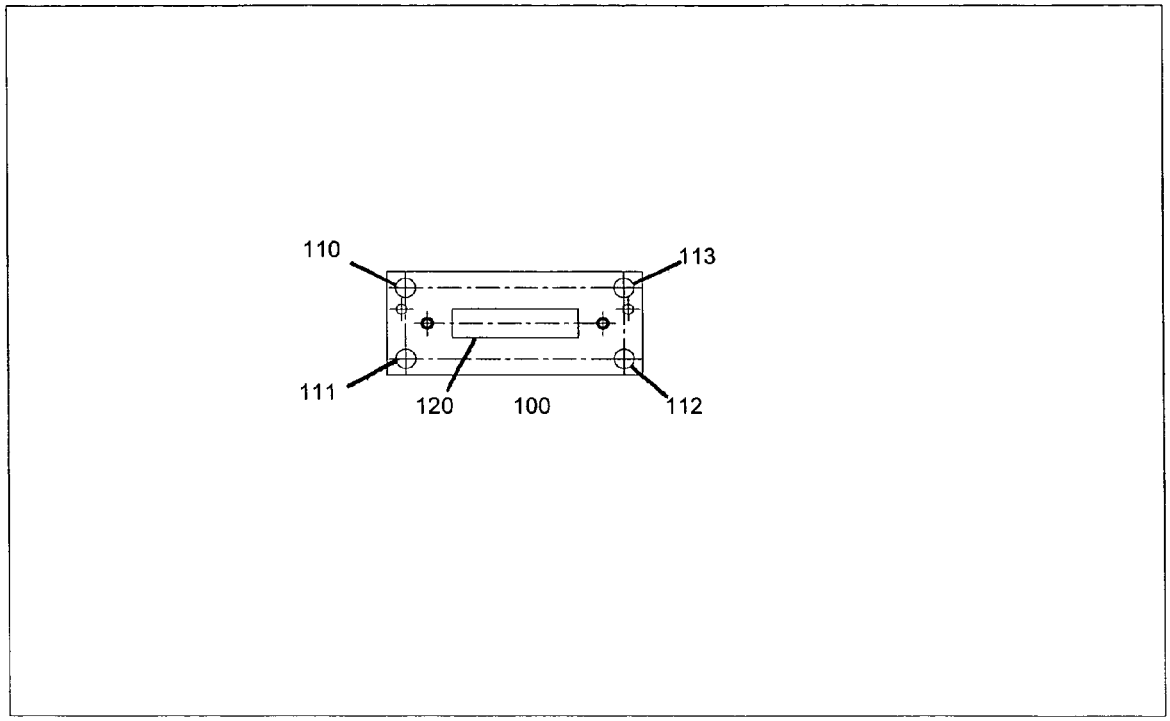
Figure 1: view of connector mounting

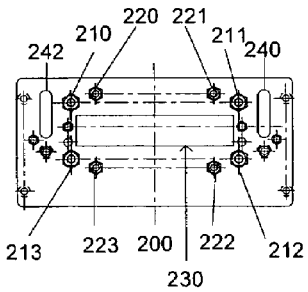
Figure 2: Connector plate and connector

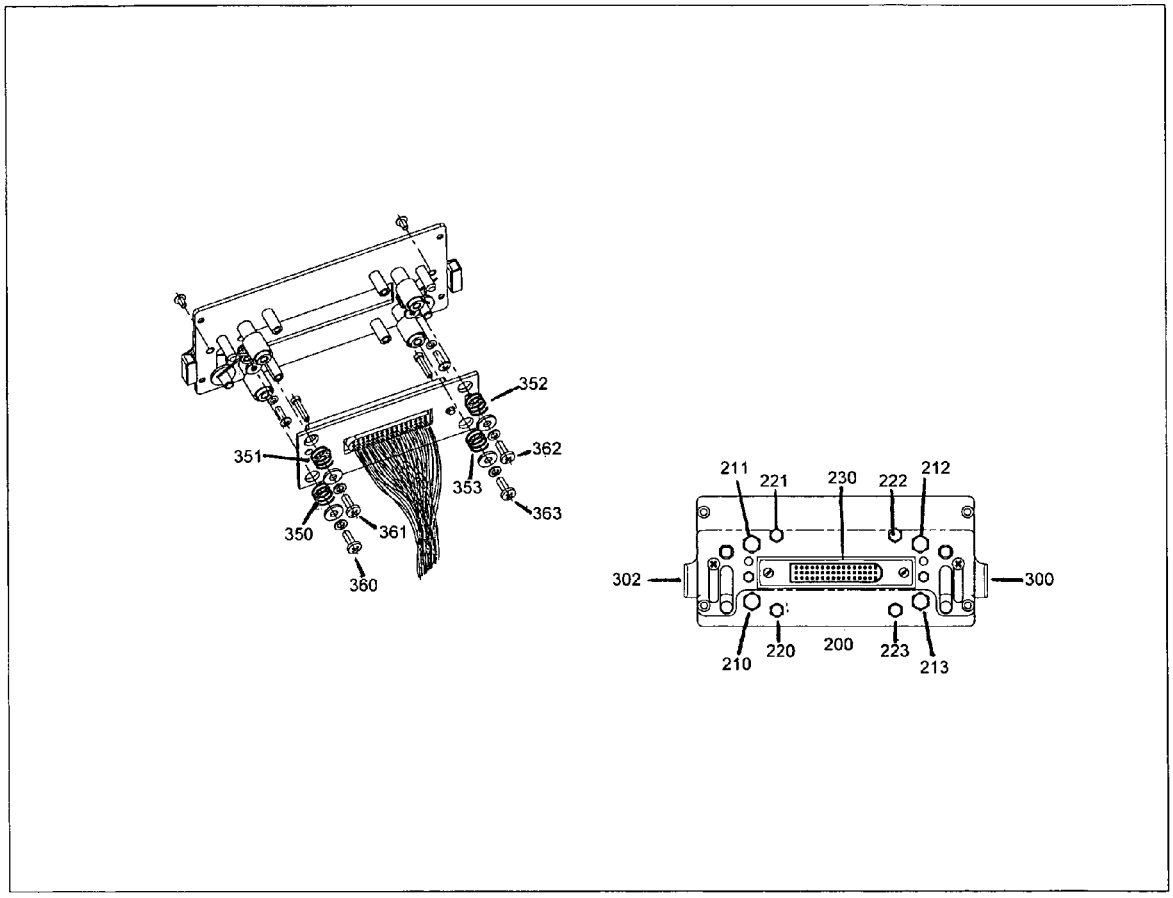
Figure 3: Assembly view with stop posts, springs, and spring posts

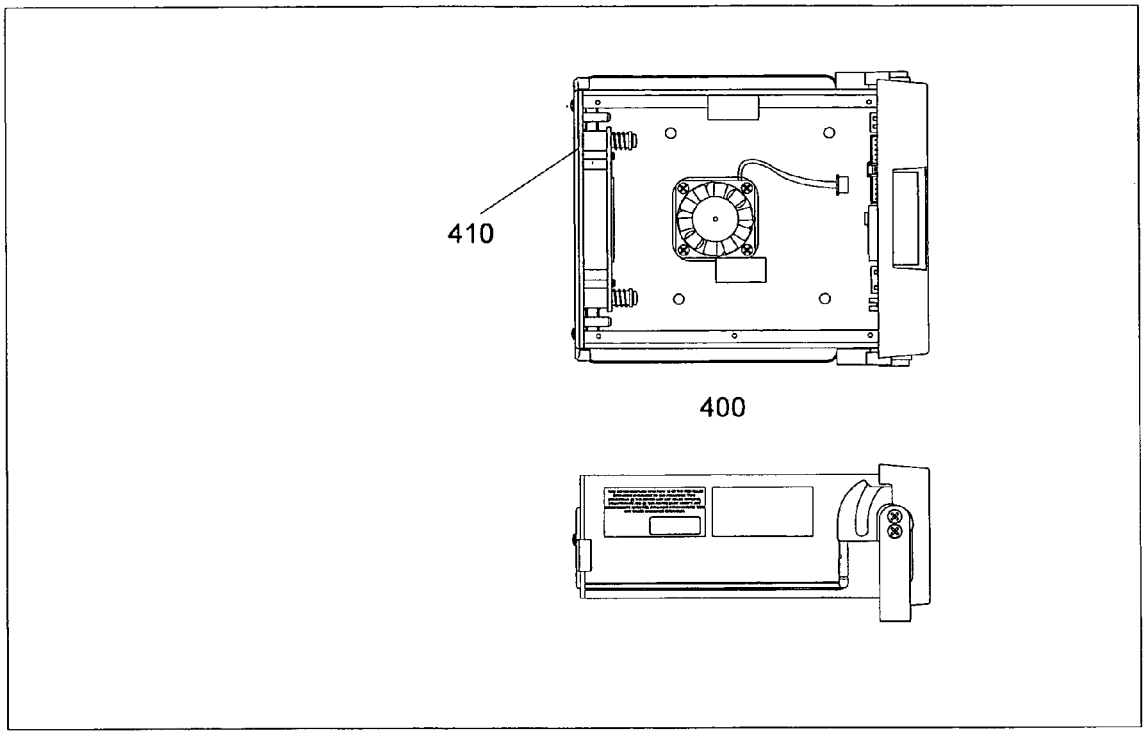
Figure 4: Spring connector assembly installed

DOCKING UNIT WITH SPRING-LOADED CONNECTOR

PRIORITY

This application claims the benefit of priority to U.S. non-provisional application Ser. No. 10/703,258 which was filed Nov. 7, 2003.

BACKGROUND OF THE INVENTION

When inserting an equipment unit into a docking station that is fixed in place, a mechanism that provides for proper alignment of the equipment and connectors attached to the equipment unit must be provided. Proper alignment of the equipment unit with the docking station provides for secure mechanical and electrical connection for all connectors, as well as guarding against mechanical damage to such connectors.

The instant invention is a novel and non-obvious means for providing shock-absorption, alignment, and secure connection for two connectors, one installed in an equipment unit and a receiving connector installed in a docking unit. The invention is an integral portion of the equipment unit and provides the ability to insert and remove the equipment unit from the docking unit without misalignment that would cause bent or damaged pins. The invention also provides for secure electrical and mechanical connectivity between the equipment unit and the docking unit through its ability to align the two connectors as the equipment unit is inserted into the docking unit.

The instant invention presents means for proper insertion orientation and protection of equipment connectors in a rugged environment, yet still providing for repeated, secure orientation, insertion, and removal to and from an equipment docking enclosure, as well as secure mechanical and electrical connectivity for connectors within the equipment unit. The instant invention thus provides a novel, non-obvious, scalable solution for vehicle-based equipment docking systems.

SUMMARY OF THE INVENTION

The instant invention is a novel spring-loaded connector device installed within an equipment unit designed to be inserted within an equipment docking unit. The device consists of a connector, connector plate, four springs, four spring posts and four stop posts. The connector is installed at the center of the connector plate. The connector plate has four stop posts and four spring posts in contact with the plate. All eight posts are attached at one end to the back surface of the equipment unit, with the unattached end within the equipment unit case. The four spring posts are inserted through connector plate, one spring post through each of the four corners of the connector plate. The four stop posts are positioned inside the spring posts and are of sufficient length to hold the spring loaded connector top surface flush with the exterior of the equipment unit back surface. The spring posts maintain tension such that any inequality of force as the equipment unit is inserted into the docking unit will be balanced and equaled such that the connector will perform an even and shock-minimized connection with the receptacle connector within the docking unit.

In this manner, the spring loaded connector achieves the proper alignment of the equipment unit with the docking station for secure mechanical and electrical connection for all connectors, as well as guarding against mechanical damage to such connectors.

BRIEF DESCRIPTION OF THE DRAWINGS

FIG. 1: view of connector plate and connector mount

FIG. 2: connector plate and connector

FIG. 3: assembly view with stop posts, springs, and spring posts

FIG. 4: spring connector assembly installed

DETAILED DESCRIPTION OF THE INVENTION

The instant invention comprises a connector 230, connector plate 100, four springs (350–353), four spring posts (210–213) and four stop posts (220–223) assembled such that the resulting device assembly 410 is properly configured to provide for secure mechanical and electrical connection for all connectors, as well as guarding against mechanical damage to such connectors.

A multi-pin connector 230, used to secure electrical connectivity between an equipment unit and the docking unit into which it is inserted, is mounted at the center of a connector plate 100. The connector plate 100 is connected to the four spring posts (210–213), springs (350–353), and four stop posts (220–223) in such a manner as to allow the connector plate 100 to float and thus equalize any misalignment or insertion fault between the equipment unit and the docking unit.

To provide the described functionality, the four spring posts (210–213) and four stop posts (220–223) are mounted as pairs. All of the posts extend through the back surface of the equipment unit and are mounted such that the hexagonal shaped heads of each of the posts are flush with the outside face of the back surface of the equipment unit. Each pair of posts is mounted such that the spring post (210–213) extends through a corner of the connector plate (110–113). The spring post (210–213) is terminated with a screw and washer (360–363), of which the diameter of the washer (360–363) is greater than the diameter of the spring post (210–213). The washer (360–363) is configured such that a spring in mounted, surrounding the post, in compression between the connector plate 100 and the washer (360–363). Thus, the connector plate 100 floats on the four springs (350–353) such that when the connector comes into contact with the receptacle connector mounted in the docking unit and there is an imbalance caused by the unequal insertion or misalignment of the either connector, the springs (350–353) equalize the imbalance and provide for even insertion of the connector into the receptacle connector. This minimizes the possibility of damage to the connector pins, yet provides for full mechanical and electrical connectivity once the equipment unit is fully inserted into the equipment docking unit.

The stop posts (220–223), located adjacent to, but not in contact with, each spring post (210–213) are configured to hold the connector plate 100 in position against the compression force of the springs (350–353). The stop posts (220–223) are also configured with a length sufficient to hold the top surface of the connector 230 flush with the outside face of the back surface of the equipment unit. Thus the stop posts (220–223) hold the connector plate 100, and the connector 230, in position such that any imbalance or misalignment during insertion of the equipment unit will be equalized by the springs (350–353).

Through the use of the unique innovations described above, this invention provides for a secure, rugged equipment unit connection and may be used within both mobile and stationary platforms without fear of damage to the equipment or loss of critical data due to poor mechanical or electrical connectivity between the equipment unit and the docking unit.

While this invention has been particularly shown and described with reference to preferred embodiments thereof, it will be understood by those skilled in the art that various changes in form and details may be made therein without departing from the spirit and scope of the invention as defined by the appended claims.

We claim:

1. An apparatus for alignment of an equipment unit when said equipment unit is inserted within a properly configured docking unit comprising:

a multi-pin electrical connector, a connector plate, at least four springs, four spring posts, four stop posts, wherein said springs and spring posts are configured to hold said connector plate and said electrical connector in tension against said stop posts, such that the connector plate with said electrical connector floats between said spring posts and said stop posts to correct any mis-alignment of the connector with a receptacle connector mounted in the properly configured docking unit when the equipment unit containing said apparatus is inserted into the properly configured docking unit.

2. An apparatus as recited in claim 1 for alignment of an equipment unit when said equipment unit is inserted within a properly configured docking unit further comprising:

said spring posts passing through the back surface of the equipment unit, with one end anchored flush with the outer face of the back surface, one spring post passing through each corner of the connector plate, a screw affixing a washer, of greater diameter than the spring post, to the non-anchored end of the spring post, and a spring, encircling the spring post, affixed between said connector plate and said washer, wherein said spring is held in compression between said connector plate and said washer.

3. An apparatus as recited in claim 1 for alignment of an equipment unit when said equipment unit is inserted within a properly configured docking unit further comprising:

said multi-pin electrical connector affixed within the center of said connector plate;

wherein said electrical connector moves in conjunction with said connector plate to maintain alignment between said electrical connector and said receptacle connector.

4. An apparatus as recited in claim 1 for alignment of an equipment unit when said equipment unit is inserted within a properly configured docking unit further comprising:

said four stop posts affixed to the inside face of the back surface of said equipment unit;

wherein said stop posts are of sufficient height to maintain an alignment of said electrical connector such that the electrical connector is flush with the outside face of the back surface of said equipment unit.

* * * * *